United States Patent [19]

Aiuola et al.

[11] Patent Number: 4,650,450

[45] Date of Patent: Mar. 17, 1987

[54] APPARATUS FOR SUPPLYING WRAPPING MATERIAL TO PACKAGING MACHINES

[75] Inventors: Franco Aiuola; Luciano Nannini, both of Bologna, Italy

[73] Assignee: Azionaria Costruzioni Macchine Automatiche, A.C.M.A., S.p.A., Italy

[21] Appl. No.: 838,988

[22] Filed: Mar. 12, 1986

[30] Foreign Application Priority Data

Mar. 13, 1985 [IT] Italy ..... 3361 A/85

[51] Int. Cl.[4] ..... F16H 55/36

[52] U.S. Cl. ..... 493/179; 493/72; 493/182; 493/310; 493/379; 493/408; 493/438

[58] Field of Search ..... 493/60, 72, 179–183, 493/310, 355, 357, 408, 409, 438, 446, 447, 455

[56] References Cited

U.S. PATENT DOCUMENTS 1,211,757 1/1917 Reitsnyder ..... 493/179

*Primary Examiner*—Frederick R. Schmidt
*Assistant Examiner*—Robert Showalter
*Attorney, Agent, or Firm*—Alan N. McCartney

[57] ABSTRACT

The invention relates to apparatus for supplying wrapping elements (2, 57) comprising elongate portions of card (2) having a series of zones (6, 7, 8, 9), separated by transverse creases (a, b), and flaps (10) defined by creases (c) disposed longitudinally to the card (2). The apparatus comprises a first mechanism (14) and a second mechanism (50) for continuously transfering the pieces of card (2) which are orientated transversely to the path of the first mechanism and longitudinally with respect to the path of the second mechanism. The apparatus also comprises folding elements (42, 43, 46, 47, 55, 56) located along the paths of the two transfer mechanisms (14, 50) arranged to fold the zones (6, 7, 8, 9) and flaps (10) about the creases defining them out of a planar condition and subsequently to fold them back to cause them to return to the original coplanar condition. The pre-creased blanks so formed can be readily wrapped by conventional wrapping machines round soft articles (68) e.g. tablets of soap, reducing the possibility of damage arising during folding.

8 Claims, 8 Drawing Figures

APPARATUS FOR SUPPLYING WRAPPING MATERIAL TO PACKAGING MACHINES

FIELD OF THE INVENTION

This invention relates to apparatus for supplying wrapping elements for machines for packaging articles for example soap.

BACKGROUND OF THE INVENTION

Soaps and other similar articles are often of a moulded shape, for example a substantially oval or pillow-like shape. For each individual article, particularly if it is moulded, it is often preferred to use a parallelpiped packaging which is provided by a kind of box, or by an actual box made of card (suitably relatively thin and flexible) and then in a wrapping of sheet material. Consequently there are packaging machines which simultaneously wrap about the article to be packaged, a piece of card, suitably die cut and scored, and a piece of sheet material and thus form the box and the related wrapping; the scoring of the blank along the lines where it is desired that the blank should fold facilitates folding at the appropriate places. Conventional, high-output, packaging machines are designed such that the article cooperates with both these wrapping elements to provide a frame of reference and a support for these elements so that the material may be wrapped around them. However, the article to be packaged can perform its operative function and its reference function in relation to the paper and card efficiently only if it is sufficiently hard and square. An oval article of the consistency of soap, processed by a conventional packaging machine, could easily be damaged if one of its narrower zones were forced against a piece of card in order to enable the latter to be folded at its score-lines for the first time, that is, if it had not previously been creased by folding about these lines. Moreover an article of oval shape would not provide, per se, a sufficient frame of reference and support for a piece of card to be wrapped about it and it would not therefore be possible to form a box satisfactorily.

Consequently, in the case of oval or, in particular, moulded soaps, specialised packaging machines have been available for some time in which the function normally carried out by the soap is performed by mechanical components which surround the soap and are retracted from the latter when the packaging is at an advanced stage of completion. The soaps are then satisfactorily processed by the specialised packaging machines, although this is relatively complex and slow and consequently productivity is low.

In order to form this type of parallelpiped box, use has recently been made of an elongate piece of card provided transversely with four score-lines. These transverse score-lines define four zones in the card intended to form the four walls of the side surface of the parallelepiped and, at one end, an end zone arranged to overlap the other end zone of the card so as to close this side surface. It is preferable for the zone at said one end to be elongated thereby forming a tongue which the consumer may use to open the package and remove the article contained therein. Apart from the end zones of the card there are therefore two adjacent zones (one adjacent each end zone) separated by a central zone. At each side the card is also provided with a pair of flaps intended to be disposed as the ends of the box. These are defined by longitudinal score-lines in the card and project from two zones adjacent to the central zone which therefore provide a pair of recesses in the card.

BRIEF SUMMARY OF THE INVENTION

An object of the present invention is therefore to provide supply apparatus for wrapping elements comprising pieces of card which can be formed to provide boxes, which supplies the elements in a condition in which they are suitable for use by the abovementioned conventional packaging machines for articles, e.g. tablets of soap, particularly when these articles are moulded.

A further object is to provide relatively simple supply apparatus which operates reliably and with a high production output for use with the above-mentioned packaging machines.

The above other objects are achieved, according to the apparatus for supplying wrapping elements for machines for packaging articles, for example soap, these elements comprising pieces of card which have a series of zones, separated by creases traverse to the piece of card and intended to define the side surface of a type of box, and flaps, defined by creases longitudianl to the piece of card and intended to form the two ends of this box. The apparatus comprises supply means supplying flat pieces of card in sequence and, first transfer means, arranged to continuously propel these pieces of card along a first path away from the supply means in such a manner that the pieces are orientated transversely to the path, and to hold a central zone of these pieces of card. A series of pairs of folding elements disposed in sequence along this path and cooperates with support means of the apparatus in such a way that, with respect to the central zone, the other zones of the piece of card passing along the path are first folded about the transverse creases defining those zones out of the plane of the central zone and then again folded about the said transverse creases so that said other zones are returned to the original condition coplanar with the central zone. The apparatus also comprises second transfer means arranged to continuously propel the pieces of card along a second path away from said first transfer means in such a manner that they are orientated longitudinally to the second path, and to hold the pieces of card by their series of zones, pairs of further folding elements disposed in sequence along the second path being arranged to fold the flaps of the pieces of card passing through the machine about the longitudinal creases out of the plane of said series of zones and then fold them back about said longitudinal creases so that the flaps again become coplanar with said series of zones.

BRIEF DESCRIPTION OF THE DRAWINGS

There now follows a detailed description to be read with reference to the accompanying drawings of apparatus for supplying wrapping elements, embodying the invention. It will be realised that this apparatus has been selected for description by way of example.

In the accompanying drawings.

DESCRIPTION OF THE PREFERRED EMBODIMENT

Figure 1:
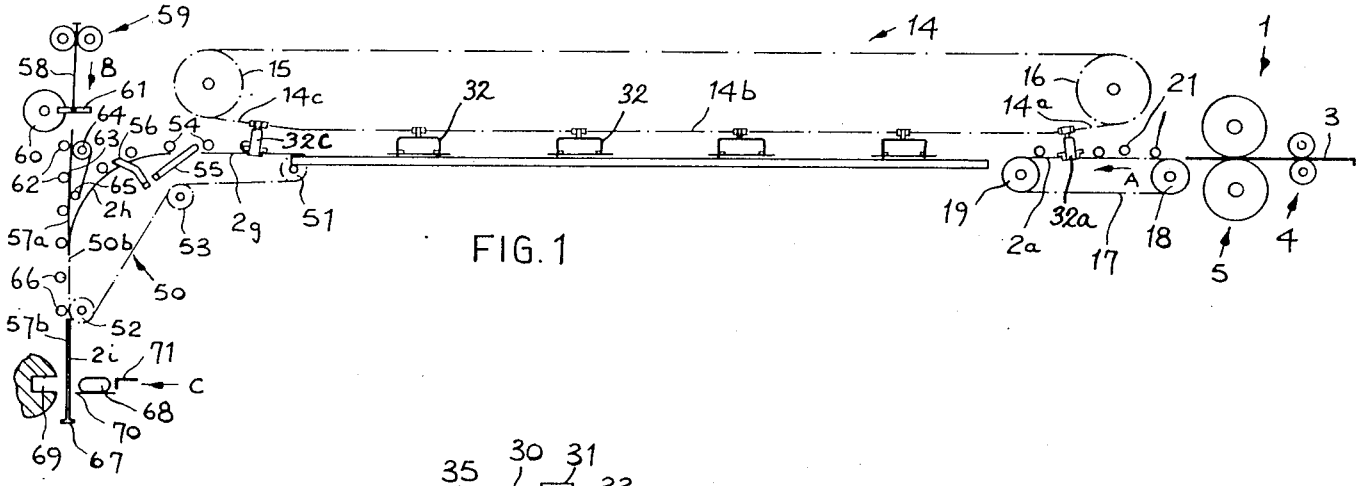
FIG. 1 is a general diagrammatic view, lengthwise and in elevation, showing the supply apparatus.
Figure 3A:
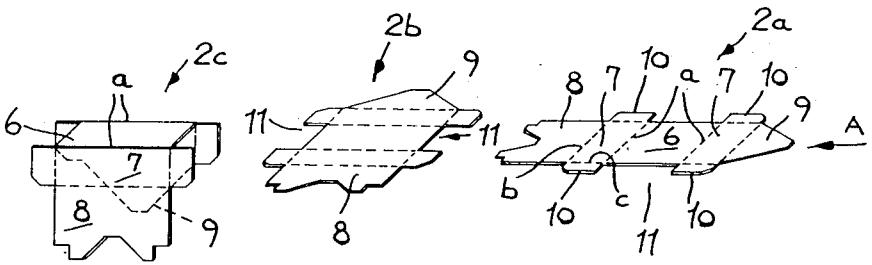
FIGS. 3*a* and 3*b* show in perspective, with reference to FIGS. 2*a* and 2*a*, the operations carried out in sequence on pieces of card.
Figure 3B:
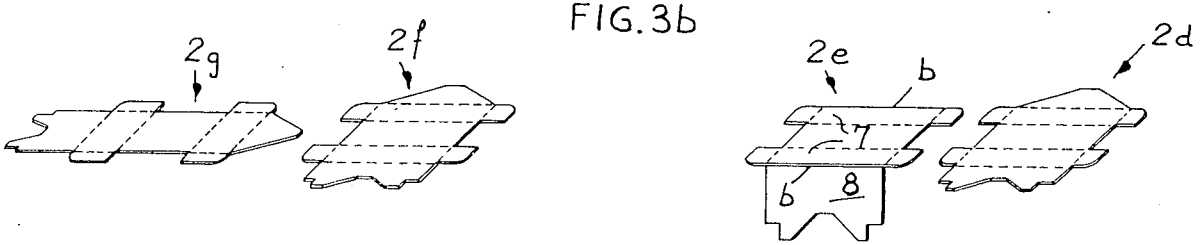

With particular reference to FIG. 1, apparatus embodying the invention for supplying wrapping elements to machines for packaging articles, for example tablets of soap, comprises means 1 which supplies, in the direction of the arrow A and in sequence, flat pieces of card 2 which are die cut and creased; the card is relatively thin and flexible. In the following description a small letter is added as a subscript to the reference numeral 2, to designate various positions, conditions and orientations of the card. In the illustrative apparatus the pieces of card 2 are obtained from a strip 3 drawn continuously by a pair of counter-rotating unwinding rollers 4 from a reel (not shown). In addition to the pair of rollers 4 the supply means 1 also comprises a pair of counter-rotating rollers 5 which receive the strip 3 from the previous rollers 4 and die cut and crease it, discharging the pieces of card 2 horizontally one after the other, whilst waste is rejected. The pair of rollers 5 does not in fact provide actual creases in the card, but rather a series of incisions (score-lines) along the various lines mentioned above on the upper surface of the card, as shown in FIGS. 3*a* and 3*b*. The pieces of card 2 have an elongate shape and a series of zones, separated from one another by transverse creases, which are designed to form the side surface of a type of box, and also have flaps produced from longitudinal creases and intended to form the two ends of the box. The piece of card of known type, which is particularly suitable for use with the supply device, is intended to form a sort of parallelepipedic box. This has a central zone 6 (FIGS. 3, 5, 6), disposed between a pair of transverse creases a, two zones 7 which are adjacent and symmetrical to the previous zone, and, at its ends, a first end zone 8 and a second end zone provided by a tongued portion 9; the end zones are separated from the adjacent zones 7 by transverse creases b. Two common longitudinal lines define the zones 6, 7 and 8. These lines are provided with longitudinal creases c by which, in register with the adjacent zones 7, substantially rectangular flaps 10 are defined. In register with the central zone 6, each long side of the piece of card therefore has a recess 11 which is bounded by two flaps 10. The edge of the end zone 8, opposite to the associated crease b, is reduced to two sections d (FIGS. 5 and 6), whose distance from the crease b equals that of the two creases a. It is preferable in fact for the end zone 8 to form, between the two sections d, a sort of inlet 12, and outwardly of these sections, a pair of cut-outs 13 with edges e parallel to the creases b. This leads to a saving in material as part of the tongued portion 9 of a piece of card is obtained from the zone 8 of the adjacent card. Only a portion of the outline of the tongued portion 9 mates with that of the inlet 12, since between the edges of the sections d and the base of the inlet, there is a smaller distance than between the vertex of the tongued portion 9 and the associated crease b, which latter distance is in turn preferably greater by half the distance between the creases a. As shown with respect to the piece of card 2*a* in FIGS. 3 and 4, it is arranged that the pieces of card emerge from the supply means 1 orientated lengthwise and with their tongued portions 9 facing upstream.

The pieces of card 2 produced and supplied by the supply means 1 are propelled, as will be explained below, along a first path moving away from the means 1 and are orientated transversely to this path. This path is aligned substantially horizontally to the supply means 1 and corresponds to a lower branch 14*a-b-c*, of a first transfer means formed by a pair of endless chains 14 running continuously in the direction of the arrow A. Two drive wheels 15 for the chains 14 are remote from the supply means 1 whilst idler wheels 16 are adjacent the supply means 1. The lower branch of each chain 14 runs between upper and lower guides (not shown) which are fixed, such that an initial portion 14*a* is slightly inclined downwardly from the wheel 16 and its final portion portion 14*c* rises slightly towards the wheel 15, whilst its central portion 14*b* is horizontal.

From the outlet of the supply means 1 to a point below the portions 14*a*, there is disposed a conveyor formed by a pair of endless belts 17 (FIGS. 1, 2*a* and 4) which pass round drive pulleys 18 and return pulleys 19. Upper branches of the belts 17 are at the level of the outlet from the supply means 1 and, supported by a plate 20, move forward in the direction of the arrow A at a speed equal to the speed of the portions 14*b* and greater than the peripheral speed of the rollers 5. Consequently, on discharge from the supply means 1, the pieces of card 2 are interposed between the upper branches of the belts 17 and a fixed sequence of superposed idler rollers 21, the flaps 10 of these cards projecting from the sides of the rollers, and are accelerated and spaced from one another.

It should be noted that downstream of the pulley 19, the stationary plate 20 terminates in a flat, horizontal portion 20*a* which has a suitable pointed configuration and extends between two shaped flanges 22*a*, although remaining separated from these. Two fixed plates 22 which are also substantially at the level of the outlet from the supply means 1 and which are on opposite sides of the path of the chains 14 have their inner edges shaped in a helical manner and in fact converge with one another downstream whilst their rear (upstream) portions, folded downwardly to a point below the portion 20*a* define the respective flanges 22*a*.

Figure 4:
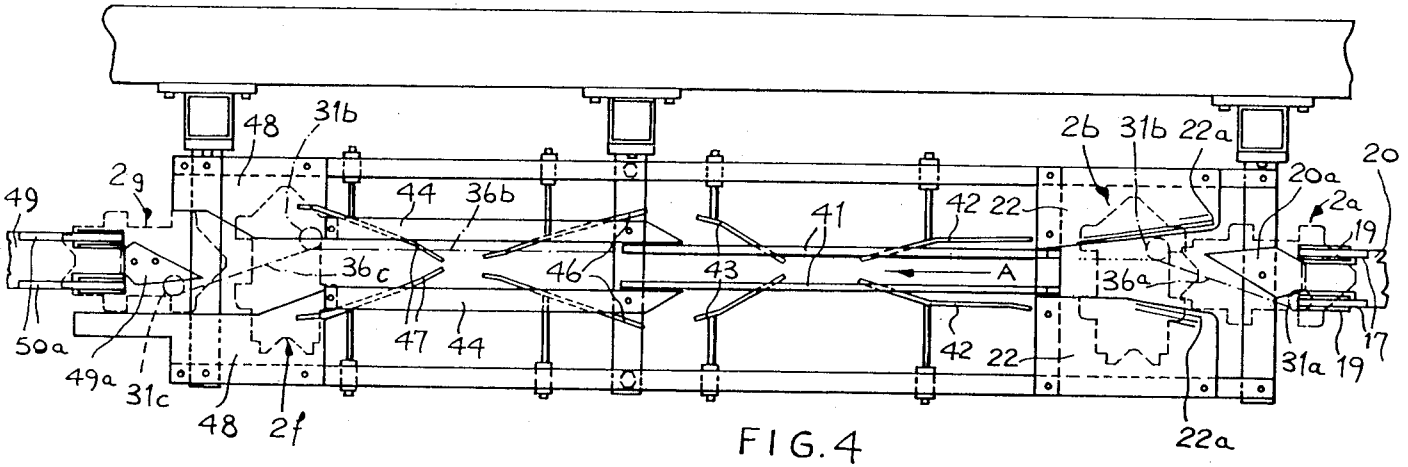
FIG. 4 is a plan view showing first transfer means.

The chains 14 are provided in a uniformly spaced manner with a plurality of supports, each of which comprises (FIGS. 2*a* and 5) a bar 23 disposed between, and parallel to, the chains. At one end of the bar (the end facing downstream along the lower branch 14*a–c*), a sleeve 24 is fixed transversely and has a pin 25 extending through it, by means of which pin the bar is supported between the two chains 14 so that it can swing about the pin 25. A prismatic central section 26*a* of a pin 26, also supported between the two chains, engages in a slot 27 provided in the bar 23 at its other end. A sleeve 28 is fixed to a central portion of the bar 23 and has its axis perpendicular to the plane of the pins 25 and 26. A pin 29 passes through the sleeve 28 and is rotatably mounted therein. The bar 23 moves with the chain 14. An arm 30 is keyed to an upper end portion of the pin 29; at an outer end portion of the arm 30 a roller 31 is mounted for rotation. A central portion of a bridge member 32 is fixed to the lower end of the pin 29. Around the top portion of the sleeve 28 there is provided a torsion spring 33 one end of which engages with a projection 34 of the arm 30, whilst its other end abuts against a lug 35 of the bar 23. The spring 33 tends per se to maintain the projection 34 in contact with the sleeve 24. In this position, each bridge member 32 is disposed transversely to the chains 14, as shown in FIG. 1 at the location of the portions 14*a* and 14*c*, in which the bridge members are designated by 32*a* and 32*c* respectively. Almost along the entire length of the apparatus corresponding with central portion 14*b* of the chains 14 there is fixed a channel cam (FIG. 4), whose initial section 36*a* and end section 36*c* is disposed at an angle to the throughfeed direction A, whilst its long central section 36*b* is parallel to the central portion 14*b* and the throughfeed direction A (the cam is shown by a single dot-dash line in FIG. 4 which is not visible for part of the section 36*b* as it is superimposed on other lines of the drawing). When the supports (comprising the bars 23) move with the lower branch of the chains 14, the rollers 31 engage with this cam 36 being urged towards the cam 36 by the springs 33. The cam 36 controls the oscillation of the bridge members 32 with respect to the supports 23–28. While the rollers 31 are engaged with the central section 36*b* of the cam (FIG. 4 shows the rollers 31 at a position 31*b* disposed at the ends of this section), the bridge members 32 are disposed longitudinally to the chains 14, as shown in the central portion of FIG. 1 and in FIG. 5. The bridge members move from the transverse to the longitudinal position by means of a rotation through 90° (for example in the anticlockwise direction with respect to FIG. 4) as their rollers 31 move from a position 31*a* (FIG. 4) passing along the section 36*a* of the cam to a position 31*b*. This rotation of the bridge members 32 leads, as will be explained below, to an identical rotation of an associated piece of card which moves from a position 2*a* at the outlet of the belts 17 into a transverse orientation 2*b* (FIGS. 3*a* and 4) above the plates 22. An opposite rotation of the bridge members and the pieces of card takes place at the end section 36*c* of the cam. Looking again at the position of the bridge member 32 in FIGS. 2*a* and 5, it can be seen that inwardly directed teeth 37 are detachably fastened to arms of the bridge. Each tooth comprises a block which, in a plane parallel to a median plane of the bridge member, has a square section defining a shoulder 38, whilst, in a plane perpendicular to the above median plane, has a T-shaped section. The shoulders 38 of both the teeth of a bridge member are arranged to provide an abutment for an upper face of the central zone 6 of a piece of card at the free edges of the zone 6, that is at the longitudinal edges of the card. The block of each tooth 37 also comprises an elongate plate 39 whose downwardly folded ends form, at the sides of the T section, respective thin tongues 39*a* which project downwardly and are slightly inclined such that they converge towards one another. Consequently below and externally to the shoulder 38, each tooth 37 has at its sides respective cut-outs 40 bounded by the tongues 39*a* and by the leg of the T-section. The pair of teeth 37 of a bridge member are designed to engage with the pair of recesses 11 of a piece of card 2 in the region of their two tongues.

Figure 2A:
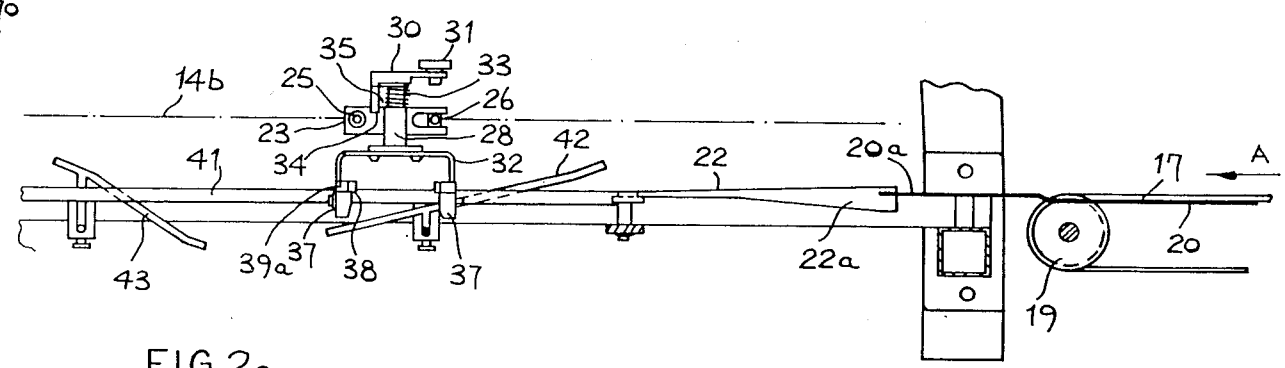
FIGS. 2*a* and 2*b* are similar views to FIG. 1, showing certain parts of the supply apparatus in greater detail.
Figure 2B:
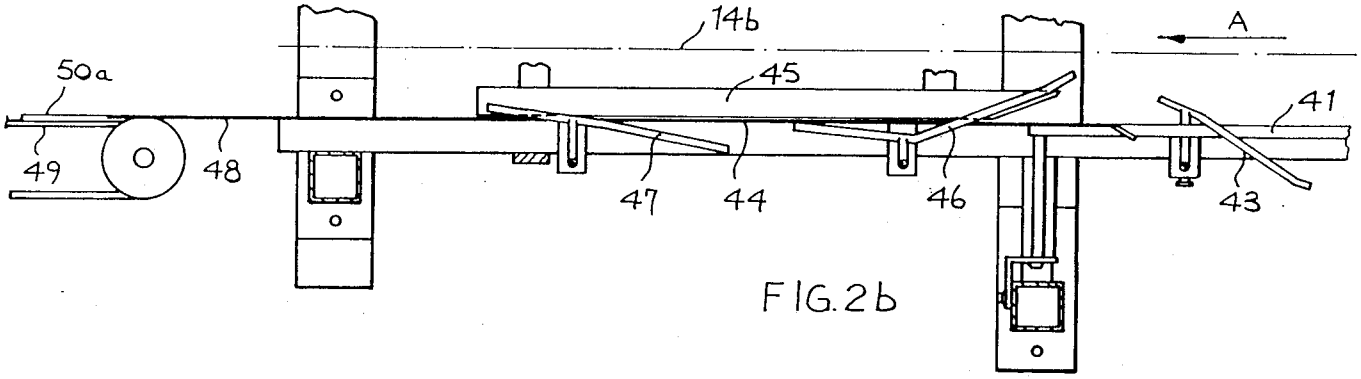
Figure 5:
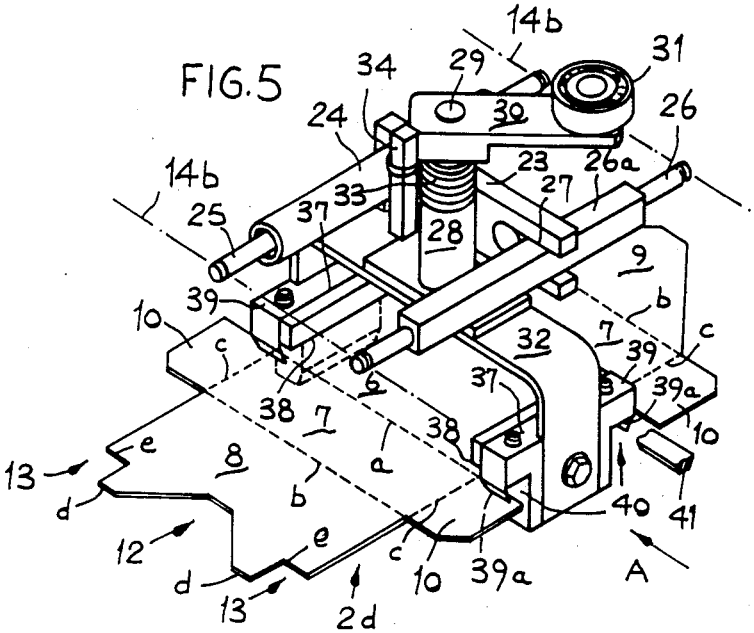
FIG. 5 is a perspective view of a detail of the first transfer means.

Each bridge member 32 (and thus its pairs of teeth 37) is arranged to be in phase with a piece of card emerging from the belts 17 as the bridge member moves downwardly as it travels along the section 14*a* of the chain 14. When a piece of card is about to emerge from the belts, its pair of recesses 11 mesh with a pair of teeth 37 of an appropriate bridge member 32, as the piece of card is orientated longitudinally and the teeth lie spaced transversely relative to the belts 17 and chains 14. The piece of card emerging from the belts held by the pair of teeth 37, is then rotated by engagement of the roller 31 with the section 36*a* of the cam. This anticlockwise (viewing FIG. 4) rotation through 90° takes place as a result of which the piece of card is orientated transversely and the teeth lie spaced longitudinally respectively. When the two teeth pass between the point 20*a* and the plates 22 and then continue between these, the piece of card moves gradually from its support on the belts 17 and the point 20*a* alone to its support on the plates 22 alone. When the transfer of the piece of card continues in the direction of A by means of the pair of teeth which are kept in their longitudinal position (that is, spaced apart longitudinally as shown in FIG. 5), the central zone 6 of the piece of card, in the vicinity of the pair of creases a, is supported on a corresponding pair of rectilinear rod-like members 41 which are fixed and extend along the apparatus corresponding to a first part of the central portion 14*b* of the chains 14 (FIGS. 2*a* and 4). The members 41 are received in the cut-outs 40 of the teeth 37, as shown in FIG. 5 in which a single member 41 is shown. Along the first part of the portion 14*b* there are also fixed in the apparatus a first and a second pair of rod-like folding members 42,43 which are symmetrical with respect to the vertical plane and disposed centrally with respect to the members 41. Both the folding members 42 of the first pair and the members 43 of the second pair are formed as rods and shaped in a substantially helical manner. The folding members 42 initially engage the upper face of the flaps 10, facing downstream, and then the upper face of the zones 7 of the piece of card passing through. The downward folding operation is carried out in opposition to the members 41 and the shoulders 38 about the creases a and thus the two zones 7 (and consequently the end zone 8 and the tongued portion 9 which remain substantially coplanar with the respective zones 7) are folded downwardly (providing in substance the position 2*c* of FIG. 3*a*). In fact before the folding members 42 cease to act on the piece of card, the folding members 43 have already begun to operate and acting in an upward direction, return the piece of card to the flat position (2*d* in FIG. 3*b*). When the transfer of the piece of card continues, the zones 7 of the latter pass above a pair of rod-like elements 44 and below a pair of rod-like elements 45 (FIGS. 2*b* and 4), which elements are rectilinear and extend along the apparatus corresponding to a second, downstream part of the central portion 14*b*. Folding members 46 acting downwardly on the zone 8 and the tongued portion 9 oppose these elements. As a result, rotation of the zone 8 and the portion 9 about the respective creases b occurs and the position of the piece of card 2*e* of FIG. 3*b* is obtained. Folding members 47 return the card to the flat position (2*f* in FIGS. 3*b* and 4), which card is then supported on a pair of plates 48. The roller 31 of the pair of teeth 37 which transfers the card, follows the cam section 36*c* under the action of the spring 33, i.e. moves from the position 31*b* to the position 31*c* and then leaves the cam. Thus a clockwise rotation through 90° occurs as a result of which the card is orientated longitudinally (piece of card 2*g*) and the teeth 37 lie spaced transversely. The teeth 37, which are rotated, pass between a pointed portion 49*a* of a plate 49 and the plates 48 and then, for a brief section, continue along the sides of the plate 49 on which an upper branch of a pair of belts 50 runs. The pointed portion 49*a* forms the end of this plate, which faces the plates 48, and is at the level of the plates 48. The piece of card, which rotates, passes from its support on the plates 48 to its support on the point 49*a* and then continues along the initial section 50*a* of the belts 50 where it begins to cease its engagement with the teeth 37 which are then moving with the portion 14*c* of the chains 14 and thus being lifted away from the piece of card.

Figure 6:
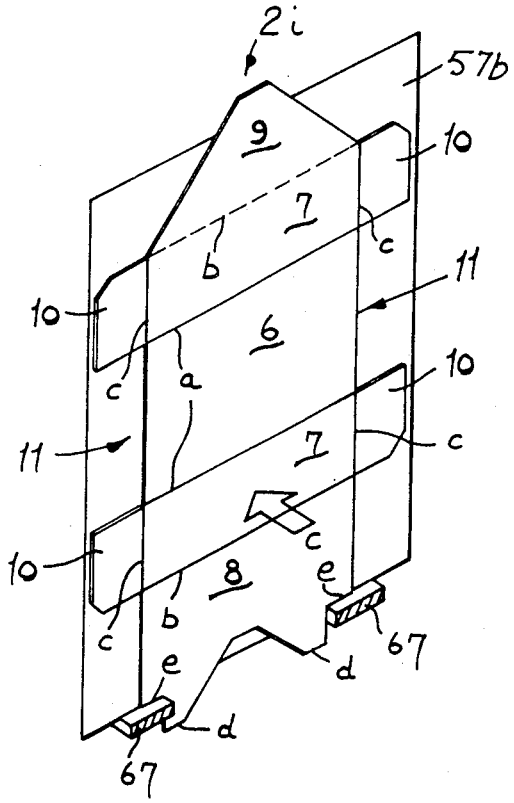
FIG. 6 is a perspective view of a wrapping element on discharge from the supply apparatus.

The belts 50 which are endless therefore form a second transfer means for the continuous transfer of the pieces of card 2 which are orientated longitudinally with respect to this means and whose flaps 10 project from the sides of these means and from the plate 49. An initial section 50*a* of the belts is at the level of the plates 48 and moves forward by means of a pair of drive pulleys 51, in the direction of the arrow A, at the same speed as the chains 14. It is preferable for an end section 50*b* of the upper branch of the belts to drop downwardly in a practically vertical manner, to a pair of return pulleys 52. Between the sections 50*a* and 50*b* the upper branch of the belts has a large arcuate section, on which a piece of card 2*h* is carried in FIG. 1. The fixed plate 49 obviously follows the same horizontal/arcuate/vertical course as the upper branch of the belts. The lower branch of the belts is engaged with the pair of pulleys 53. When they have been discharged from the first transfer means, that is the chains 14, the pieces of card 2, at the location of the series of zones 6, 7 and 8, are interposed between the upper branch of the belts 50 and a fixed sequence of superposed idler rollers 54 and reach a first pair 55 and then a second pair 56 of fixed folding members. The folding members 55 are shaped and disposed such that they engage from the top with the projecting flaps 10 and fold them downwardly about the creases c. The folding members 56, however, raise these flaps 10 such that they again become coplanar with the adjacent zones 7 before reaching the end section 50*b* of the belts. On the same vertical as this section there is disposed the outlet of means which supplies in the direction of the arrow B and in sequence flat pieces of paper 57. In the illustrative apparatus the pieces 57 to come from a strip 58 which is continuously taken from a reel (not shown) by a pair of counter-rotating unwinding rollers 59 and inserted between a rotating roller 60 with a blade and a fixed counter-blade 61. Before the blade of the roller 60 has separated each piece of paper 57 from the strip 58 the piece of paper 59 will have already been inserted between a vertical sequence of idler rollers 62 and the descending branch 63 of a pair of belts. This latter pair of belts stands above the arcuate portion of the belts 50 and has a pair of drive pulleys 64 and a pair of return pulleys at 65. As soon as the blade of the roller 60 has cut the piece of paper 57 from the strip 58 the piece is displaced by the branch 63 and is accelerated until it reaches the same speed as the end section 50*b* of the belts 50. The piece of paper 57 is therefore spaced from the free end of the strip 58. The discharge of a piece of card 2 from the first means 14 and the cutting of a piece of paper 57 from the strip 58 are suitably phased such that the lower edge both of the piece of card 2*h* and the piece of paper 57*a* reach the inlet of the branch 50*b* simultaneously. The paper and the card, in contact, then continue between the section 50*b* of the belts and a vertical sequence of idler rollers 66 and then emerge and are supported on abutments 67 (card 2*i* and paper 57*b*). As shown in FIG. 6, the piece of paper 57*b* is rectangular and has a width and a length which are slightly greater and smaller respectively than those of the overall piece of card 2. When the paper and the card are positioned in contact one of the shorter edges of the paper (the lower edge) is positioned in alignment with the edges e of the cut-outs 13 of the card. The pair of members from which the abutment 67 is formed support the paper and card in the region of these cut-outs 13. From the upper edge of the paper there projects the vertex of the tongued portion 9 which therefore projects from the packaging in order to facilitate the opening of the latter and the use of the article 68 contained therein.

The card 2*i* and the paper 57*b* are ready for use by a conventional packaging machine. FIG. 1 shows diagrammatically an inlet station of a suitable packaging machine in which a pocket 69 is provided in a type of drum, a so-called tumbler box. The pocket 69 faces the paper 57*b* and in practice the portion of the latter corresponding to the zone 7 of the card 2*i* which is adjacent to the end zone 8. The article 68 to be wrapped also faces towards the same zone 7 of the card, carried on a support 70. A reciprocating thrust element 71 by performing an operative stroke in a direction C firstly pushes the article 68 against the assembly of the two wrapping elements 2*i* and 57*b* and then inserts the article and the assembly into the pocket 69. By means of this insertion the zone 7 is disposed against the base of the pocket and its flaps 10 are rotated about the creases c and are disposed parallel to one another and perpendicular to the said zone 7, and finally the zones 6, 8 rotate about the creases a, b and are disposed parallel to one another and perpendicular to the zone 7 and to its flaps 10. The above folds and those carried out subsequently by the packaging machine take place in a conventional manner. However, in the case of packaging machines which do not have the illustrative supply apparatus described above, both the wrapping elements are provided with the same folds for the first time. In contrast, within the illustrative supply apparatus the stiffer of the two wrapping elements, i.e. the card, has already been subjected to the folds which are again produced in the packaging machine. It is therefore evident that in the supply apparatus the card is subjected to a weakening, pre-folding operation at the location of its creases and that the article 68 encounters little resistance when it forces the two wrapping elements to fold as it is inserted into the pocket 69.

We claim:

1. Apparatus for supplying wrapping elements for machines for packaging articles, for example soap, these elements comprising pieces of card which have a series of zones, separated by creases transverse to the piece of card and intended to define the side surface of a type of box, and flaps, defined by creases longitudinal to the piece of card and intended to form the two ends of this box, wherein the apparatus comprises supply means supplying flat pieces of card in sequence, first transfer means, arranged to continuously propel these pieces of card along a first path away from the supply means in such a manner that the pieces are orientated transversely to the path, and to hold a central zone of these pieces of card, a series of pairs of folding elements disposed in sequence along this path and cooperating with support means in such a way that, with respect to the central zone, the other zones of the piece of card passing along the path are first folded about the transverse creases defining those zones out of the plane of the central zone and then again folded about the said transverse creases so that said other zones are returned to the original condition coplanar with the central zone, second transfer means arranged to continuously propel the pieces of card along a second path away from said first transfer means in such a manner that they are orientated longitudinally to the second path, and to hold the pieces of card by their series of zones, pairs of further folding elements disposed in sequence along the second path and arranged to fold the flaps of the pieces of card passing through the machine about the longitudianl creases out of the plane of said series of zones and then fold them back about said longitudinal creases so that the flaps again become coplanar with said series of zones, the series of zones comprise a central zone, two zones adjacent thereto, and two end zones at opposite end portions of the piece, and which also have flaps defined by longitudinal creases projecting from said adjacent zones, the flaps bounding two recesses located at opposite sides of each piece of card in register with its central zone, wherein the supply means and the first and second transfer means are disposed in alignment one after the other and in which the supply means is so constructed and arranged as to supply the pieces of card in sequence each with the same orientation and wherein the first transfer means comprises a uniformly spaced plurality of supports on each of which is mounted for rotational movement a pair of teeth so constructed and arranged as to be received in the pair of recesses of a piece of card and to engage the central zone at opposite edge portions thereof, and in which along the path of the first transfer means cam means are situated to control the rotational movement of this pair of teeth so that in initial and terminal end portions of the path the piece of card is disposed lengthwise of the path and in the central portion of this path the piece of card is disposed transverse to the path, so that along this central portion the transverse creases of the card lie parallel with the path of movement of the first transfer means.

2. Apparatus according to claim 1 wherein the support means comprises a pair of rectilinear parallel rod-like members disposed along a first part of the central portion of the path of the first transfer means and arranged to support the central zone of a piece of card travelling along the path in the vicinity of the transverse creases defining the central zone and opposite to the pair of teeth, and wherein the folding elements comprise a first and a second pair of folding members having a generally helical shape arranged to engage the adjacent zones and effect folding thereof about the transverse creases defining the central zone out of the plane of the central zone and then folded back to return then to the original coplanar condition, the apparatus further comprising a further two pairs of parallel rod-like members disposed along a second part of the central portion of the path of the first transfer means arranged to engage a piece of card in the vicinity of the transverse creases of the card separating the end zones from the adjacent one of the adjacent zones, one of this further pair of members engaging one face of the card and the other of this further pair engaging the other face, and wherein the folding elements comprise a third and a fourth pair of folding members having a helical shape and arranged to engage the end zones and effect folding thereof about the transverse creases separating the end zones from the adjacent one of the adjacent zones out of the plane of the central zone and then folded back to return them to the original coplanar condition, said further two pairs of rod-like members having a greater spacing between them than the spacing between the rod-like members disposed along the first part of the central portion of the path.

3. Apparatus according to claim 2 wherein each tooth comprises a thin tongue at each side, the tongues defining, at these sides, associated cut-out portions of the tooth arranged to cooperate with the rectilinear rod-like members fixed along the first part of the central portion of the path section.

4. Apparatus according to claim 3 comprising a unit supplying in sequence pieces of paper to the end portion of the second transfer means in such a way that these pieces of paper are associated with pieces of card at the outlet of the second transfer means.

5. Apparatus according to claim 4 wherein the unit for the sequential supply of the pieces of paper comprises rollers for unwinding a strip of paper from a respective spool and a rotating blade for cutting the paper.

6. Apparatus according to claim 5 wherein the supply means supplying the pieces of card in sequence comprises rollers for unwinding a strip of card from a reel and rollers, operating at the same peripheral speed as the preceding rollers, for die cutting and scoring of the strip.

7. Apparatus according to claim 5 wherein between the unit for the supply of the paper and the end portion of the second transfer means there is disposed means for accelerating the pieces of paper from the peripheral speeds of the said rollers of the supply unit to the speed of the second transfer means.

8. Apparatus according to claim 6 wherein between the supply means for the card and the initial portion of the first transfer means is disposed means for accelerating the pieces of card from the peripheral speed of the rollers to the speed of the first transfer means.

* * * * *